US006252504B1

(12) United States Patent
Parker

(10) Patent No.: US 6,252,504 B1
(45) Date of Patent: Jun. 26, 2001

(54) ALARM SYSTEM USING LOCAL DATA CHANNEL

(75) Inventor: James Parker, Thornhill (CA)

(73) Assignee: Digital Security Controls Ltd., Concord (CA)

( * ) Notice: Subject to any disclaimer, the term of this patent is extended or adjusted under 35 U.S.C. 154(b) by 0 days.

(21) Appl. No.: 09/495,353

(22) Filed: Feb. 1, 2000

(30) Foreign Application Priority Data

Feb. 2, 1999 (CA) ..... 2260680

(51) Int. Cl.[7] ..... G08B 1/08

(52) U.S. Cl. ..... 340/533; 340/507; 340/536; 379/39; 379/45

(58) Field of Search ..... 340/506, 507, 340/531, 533, 536; 379/39, 44, 45

(56) References Cited

U.S. PATENT DOCUMENTS 5,283,816 * 2/1994 Diaz ..... 379/40

* cited by examiner

*Primary Examiner*—Daryl Pope

(57) ABSTRACT

The alarm system has an alarm unit for ready access at a point of entryway which communicates with a line seize module located in a secure location. The alarm unit has a transmitter receiver, a control panel function, a key pad, and an input/output port for connection to telephone wiring for communicating with the line seize unit. The line seize module includes its own input/output communication port connected to the wiring of the local telephone line and as such, is in direct communication with the alarm unit. Communication is separate and distinct from normal telephone communication and preferrably is at a high frequency above the audible range. This allows the alarm system to communicate between components while still allowing full conventional use of the telephone lines. The line seize module also includes control logic, a line seize arrangement and an automatic dialer. When an alarm condition occurs, the alarm unit transmits a signal to the line seize module which then takes appropriate steps to contact the remote monitoring station via the telephone system. This two part alarm system which communicates over the existing telephone wiring, reduces the vulnerability of the system to defeat.

5 Claims, 1 Drawing Sheet

ALARM SYSTEM USING LOCAL DATA CHANNEL

FIELD OF THE INVENTION

The present invention relates to alarm control panels and in particular, to a simplified alarm control panel that uses a local data channel to communicate with a remote line seize module.

BACKGROUND OF THE INVENTION

Alarm security systems traditionally have an alarm control panel located in a secure area to reduce the possibity of defeating the system by destroying the control panel before an alarm condition can be reported. The control panel includes a line seize module as part thereof, or has a line seize module in immediate proximity to the alarm control panel. The control panel upon identifying an alarm condition uses the line seize module to seize the telephone line and dial the remote monitoring station. In this way, the processing circuitry for determining alarm conditions and communicating those alarm control conditions to a remote monitoring station over the telephone lines our located in a secure environment and cannot be immediately destroyed. With this arrangement the control panel communicates with a wireless key pad or a hardwire key pad typically located near an entryway. The control panel is also in communication with various sensors distributed throughout the premise.

Wireless alarm control systems have the distinct advantage of being easy to install as it is not necessary to physically connect the individual sensors and the keypad with the control panel. Furthermore, after installation, if there is a problem with the location of a sensor, it can easily be moved to a new location and the sensor continues to communicate with the control panel. The components of wireless systems tend to be more expensive to manufacture but the installation of wireless systems is more cost effective, requires less skill, and is easily changed if necessary.

A cost effective security systems has been proposed which includes an all in one system combination control panel located near the entryway to the premise. The combination control panel combines the control panel, key pad, line seize module, and sounder as a single unit. This combination control panel communicates with wireless sensors distributed throughout the house. This combination unit also includes an input/output port to connect the unit to the telephone system. The integration of all these components into a single unit makes the installation quite simple and substantially reduces the manufacturing costs. Unfortunately, it also greatly increases the risk that the alarm system can be compromised before an alarm signal is transmitted to the telephone company by physically destroying the unit.

The present invention provides many of the advantages of the combination control panel while rendering the system less vulnerable to defeat.

SUMMARY OF THE INVENTION

An alarm system according to the present invention comprises an alarm unit having a transmitter receiver, a control panel function, a key pad, and an input/output port for connection to a telephone line. This alarm unit is placed in close proximity to an entryway of the premise to be protected. The alarm unit cooperates with a separate and distinct line seize module which is placed in a secure location where it is connected to a telephone line. The line seize module includes its own input/output communication port connected to the local telephone line and as such, can communicate with the alarm unit over this existing network. Communication is at a high frequency above the audible range, and as such, can be simultaneous with use of the line for its conventional purpose. The line seize module also includes control logic, a line seize arrangement and an automatic dialer. The control logic is connected to the input/output port and signals are sent by the alarm unit to the line seize module and are received and processed by the control logic. When an alarm condition occurs, the control logic receives the signal from the alarm unit and then takes the appropriate steps to contact a remote monitoring station via the telephone system. This two part alarm system which communicates over the local data channel reduces the vulnerability of the system during a break in.

The line seize module can be placed in a relatively secure position and communication from the alarm unit to the line seize module can happen essentially instantly, or certainly, prior to destruction of the alarm unit.

In a preferred aspect of the invention, the line seize module includes logic for determining whether the alarm unit is active and should the alarm unit not send a heartbeat type signal to the line seize module, the line seize module can determine that an alarm condition exists and act on its own to contact the remote monitoring station and report the condition.

The above arrangement has relatively low manufacturing costs as many of the components have been integrated into a single alarm unit which cooperates with a separate and distinct line seize module.

In a preferred embodiment of the invention, the line seize module also includes a filter for limiting any signals between the alarm unit and the control logic of the line seized module to the local data channel within the premise being protected. As such, signals are not transmitted beyond the premise and will not interfere with the telephone system.

The local channel is the telephone wiring within the premise and the alarm unit and the line seize module share this channel with existing equipment however in the preferred embodiment the existing equipment are isolated during reporting of an alarm.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
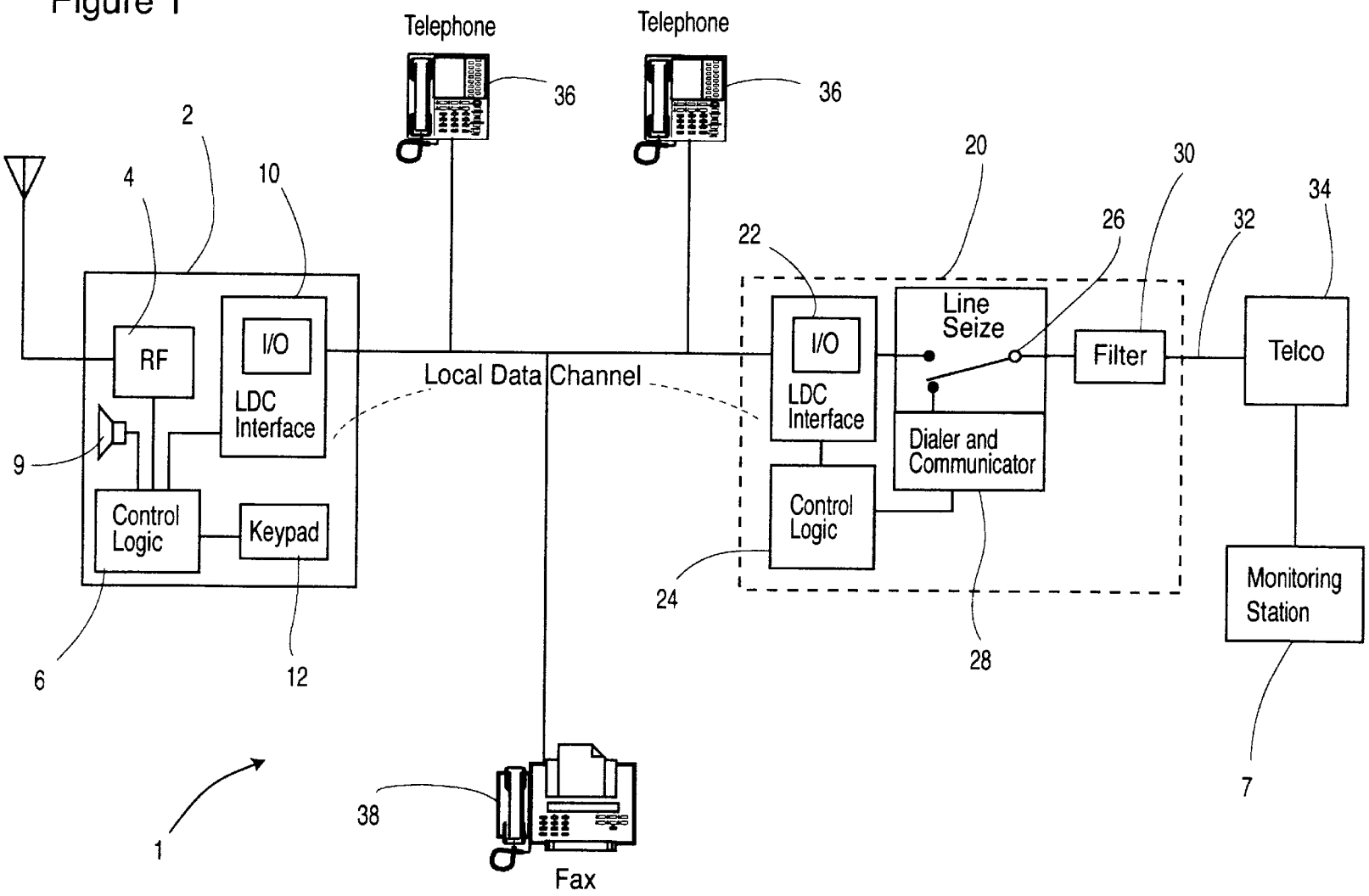
FIG. 1 is a schematic view of the alarm system.

The alarm system 1 includes three basic components, these being the alarm unit 2, the line seize module 20 and the local data channel 16, which are the existing telephone lines located within the household or premise being protected.

This system uses the publicly switched telephone network to contact a remote monitoring station 7. The poprtion 32 of the telephone line connects the premise to the public telephone system 34.. The filter 30 and the line seize module 20 are located between the public telephone system and the local telephone lines. In this way, the various telephones and other telephone equipment that are on the local telephone line 16, are all located downstream of the filter 30 and the line seize module. Thus, the telephone 36 and the facsimile machine 38, as well as the alarm unit 2, are all downstream of the line seize module 20 and the filter 30.

The alarm unit 2 is similar to an all in one alarm system in that it includes an integrated transmitter receiver 4, control panel logic 6 for processing the signals from sensors, a key pad 12, a sounder 9, and an input/output communication port 10 for connection to the telephone line 16. The input/output port 10 includes a transmitting arrangement for transmitting a high frequency signal from the alarm unit to the line seize module 20. The frequency of this communication signal is preferrably above the audible range and as such, it will not interfere with the normal operation of the telephone equipment 36, 38, which are on the local data channel 16.

The line seize module 20 will typically be located in the basement of a house adjacent the point of entry of the telephone service to the household. The unit includes an input/output communication port 22 which also includes a signal generating and receiving capability for the high frequency signals from the alarm unit. There is two way communication between the alarm unit and the line seize module. The control logic 24 of the line seize module 20 evaluates the signals received from the alarm unit and takes appropriate action with respect to the line seize relay 26 and the dialer and communicator 28. When an alarm is detected or recognized by the control logic 24, based on signals received from the alarm unit, the telephone line is seized by the line seize relay 26 and directly connects the dialer 28 to the telephone system. This is the position of the relay shown in FIG. 1. In such a position, the telephones 36 and the facsimile machine 38 have been isolated from the public telephone system and there is no voltage on the local data channel 16 between the line seize module and the alarm unit. If desired, such a voltage could be applied but that would not be the case with respect to the structure as shown in FIG. 1.

The alarm unit 2 continues to communicate with control logic 24 using the local channel 16. This communication back and forth does not rely on any voltage being present on this line. With the arrangement shown in FIG. 1, if the alarm unit 2 detects an alarm condition, such as the unauthorised opening of an entryway, it communicates the alarm condition to the control logic 24 over the local data channel 16. This communication occurs quickly and is stored by the line seize module 20 for eventual communication to the remote monitoring station 7. The line seize module 20, upon receiving such a signal, seizes the telephone line, dials the remote monitoring station, and transmit thereto the alarm condition based on information received and provided by the control logic 24. If the alarm unit 2 is destroyed or disconnected from the local data channel 16, the alarm condition has already been transmitted to the line seize module and the alarm condition will be communicated to the remote monitoring station.

This arrangement provides a higher degree of safety relative to an all in one alarm device while still providing substantial reduction in manufacturing costs. The telephone line within the premise is a particularly desirable communication channel. Many homes are wired to have two pairs of telephone lines and often one pair of the telephone lines are not used. If this is the case, the alarm unit could use the additional pair of wires but it is not necessary as transmission at a higher frequency above the audible range allows normal telephone communication and alarm signal communication simultaneously. The communication between the alarm unit and the line seize module do not interfere with normal use of the telephone system. Conventional telephone devices are designed to transmit and receive signals in the audible frequency range, which is normally between 1000 and 3000 Hz and will not be affected by the high frequency signal. The filter 30 is designed as a high frequency choke and does not pass the high frequency signal. In this way, the high frequency signal is limited to the local data channel within the premise.

The local data channel 16 allows the alarm unit 2, to communicate with the line seize module 20 located in a secure location remote from the alarm unit 2 and these units are easy to install. The high frequency communication between components of the alarm system does not interfere with the normal operation of the telephone services and the normal telephone services are preferrably cut off during the reporting of an alarm condition to the remote monitoring station. The the alarm unit 2 can be located at any position on the local channel downstream of the line seize module.

The alarm unit 2 communicates with RF sensors which are distributed throughout the household or premise. Signals are transmitted and received between the alarm unit and the sensors via the transmitter receiver 4.

The installation time with respect to the above system is quite short and requires a relatively low skill level. The alarm unit 2 is located near an entryway and close to a connection point for the existing local telephone wiring 16. The line seize module is located in a secure location adjacent the entry point of the telephone line to the premise. The various sensors can be appropriately located throughout the premise. The alarm unit 2 and the line seize module 20 preferrably communicate on an on going basis, and as such, the line seize module 20 can detect a condition where the alarm unit 2 is not reporting. This condition is reported as a separate alarm event to the remote monitoring station. With this arrangement, a secure alarm system is provided which is easy to install and also has reduced manufacturing costs as many of the components have been integrated into the alarm unit 2.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed and defined as follows:

1. An alarm system for a household or premise comprising an alarm unit in combination with a line seize module;

said alarm unit including a transmitter/receiver, a control panel function, a key pad, and an input/output port connected to a telephone line of said household or premise;

said line seize module including an input/output communication port connected to said telephone line, a signal transmitter and receiver communicating over said telephone line with said alarm unit, control logic, a line seize arrangement and an automatic dialer; said control logic processing signals received by the input/output port and causing signals to be transmitted through said input/output port to said alarm unit;

said alarm unit and said line seize module communicating over said telephone line such that the communications therebetween are independent of any telephone communication on said telephone line;

said line seize module upon receiving an alarm signal from said alarm unit reporting the signal to a remote monitoring station using the public telephone system.

2. An alarm system as claimed in claim 1 wherein said alarm unit and said line seize module communicate using a signal of a frequency outside of the audible range.

3. An alarm system as claimed in claim 2 wherein said frequency is above the audible range.

4. An alarm system as claimed in claim 2 including a choke filter located between said line seize module and the public telephone system which blocks said frequency outside of said audible range.

5. An alarm system as claimed in claim 4 wherein said alarm unit is located adjacent an entryway to a premise being protected and said line seize module is located in said premise in a position of higher security relative to the position of said alarm unit.

* * * * *